United States Patent [19]

Butler

[11] 4,443,978

[45] Apr. 24, 1984

[54] MOVABLE THERMAL BARRIER FOR SOLAR HEATED BUILDING

[75] Inventor: Robert B. Butler, Carmel, N.Y.

[73] Assignee: Butler-Merritt Inc., Mahopac, N.Y.

[21] Appl. No.: 449,682

[22] Filed: Dec. 14, 1982

[51] Int. Cl.[3] ..... E04B 1/62; E06B 3/00

[52] U.S. Cl. ..... 52/1; 49/31; 49/63; 52/64; 52/173 R; 52/207

[58] Field of Search ..... 52/1, 173, 64, 200, 52/207, 404, 407; 49/1, 31, 63, 370; 47/17; 126/417, 419

[56] References Cited

U.S. PATENT DOCUMENTS

| | | | |
|---|---|---|---|
| 3,777,241 | 12/1973 | Wenger et al. | 49/31 |
| 4,083,148 | 4/1978 | Saucier | 49/63 |
| 4,128,307 | 12/1978 | Badertscher et al. | 52/64 |
| 4,267,666 | 5/1981 | Davidson | 49/63 |
| 4,294,038 | 10/1981 | Davidson | 49/63 |
| 4,306,387 | 12/1981 | Hopkins et al. | 52/1 |
| 4,370,826 | 2/1983 | Davidson | 49/63 |

FOREIGN PATENT DOCUMENTS

| | | | |
|---|---|---|---|
| 492539 | 5/1953 | Canada | 49/63 |
| 336593 | 2/1936 | Italy | 49/63 |
| 1302699 | 1/1973 | United Kingdom | 49/31 |

*Primary Examiner*—J. Karl Bell
*Attorney, Agent, or Firm*—S. C. Yuter

[57] ABSTRACT

A movable thermal barrier for a two-story building having a glass wall facing in a southerly direction and comprising a thermally insulated horizontal stationary rail panel adjacent to the glass wall. A thermally insulated horizontal movable inner panel is positioned between the rail panel and the glass wall, and is movable from horizontal alignment with the rail panel to above the rail panel. A similar outer panel is positioned between the inner panel and the glass wall and is movable from horizontal alignment with the rail panel to below the rail panel. Panel mounting means supported from the building are adapted to movably support the inner and outer panels so that one may be moved above and the other below the rail panel to provide a translucent thermal barrier between the upper and lower portions of the glass wall and the inside of the building. The inner and outer panels are of similar weights so they balance each other. Each of the inner and outer panels may be made from several panel sections flexibly connected together. An automatic control system operates the movable inner and outer panels to create comfortable temperatures inside the building all year around.

52 Claims, 18 Drawing Figures

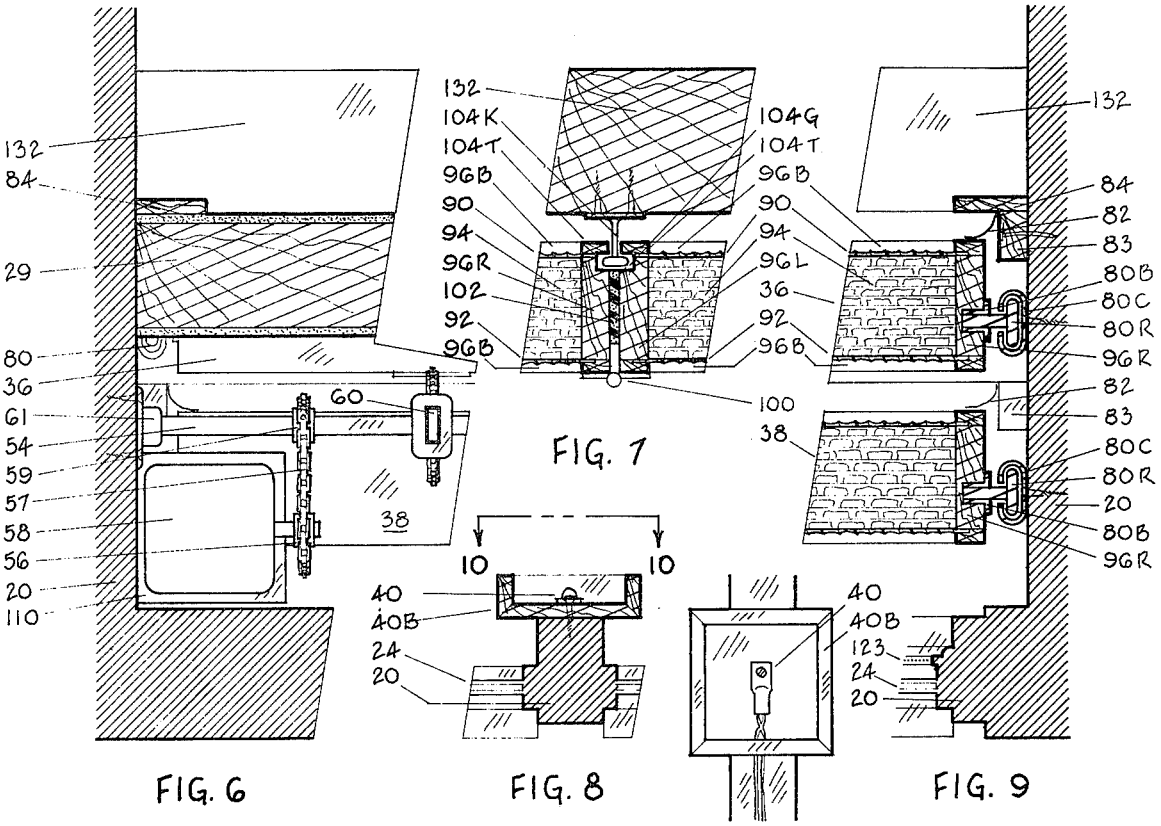
FIG. 6 FIG. 7 FIG. 8 FIG. 9
FIG. 10
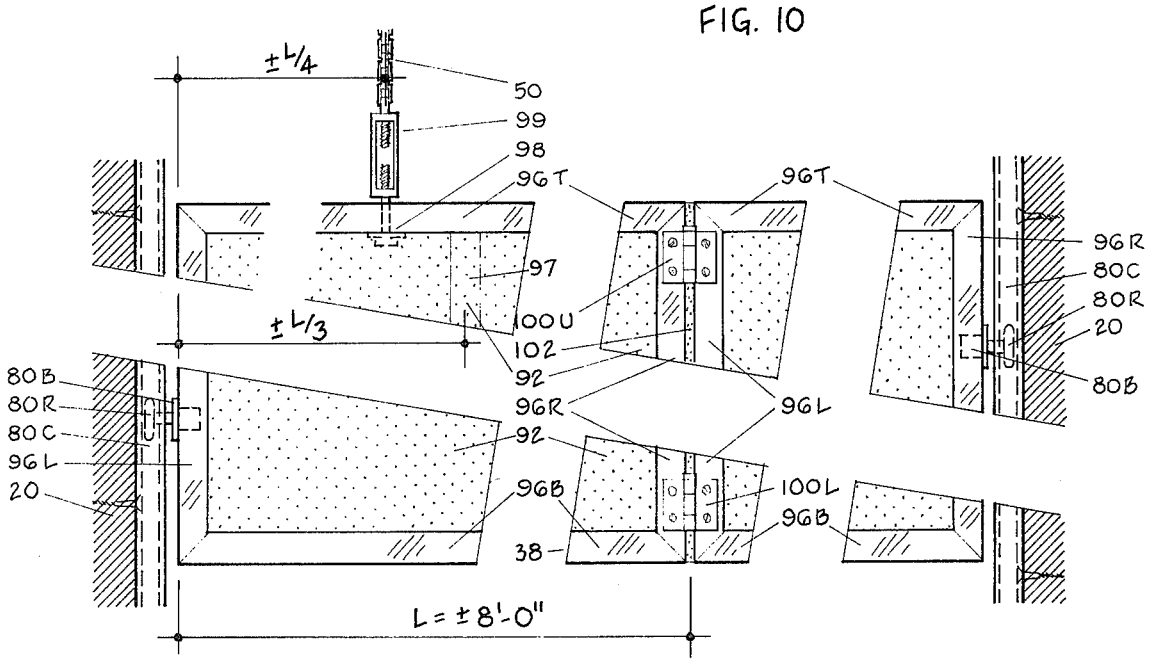
FIG. 11 FIG. 12 FIG. 13

MOVABLE THERMAL BARRIER FOR SOLAR HEATED BUILDING

FIELD OF THE INVENTION

This invention relates to energy saving systems and more particularly to a movable thermal barrier for a solar heated building having a large glass window area.

BACKGROUND OF THE INVENTION

Buildings with large areas of glass, especially solar heated houses with two-story glass windows facing in a southerly direction, present a number of problems in maintaining rooms comfortable while saving energy. One problem is that the rooms behind the glass wall may collect too much sunshine and heat to an uncomfortable level. Another problem is that too much heat may flow back out through the panes on cloudy days and cold nights. Another problem is that buildings having two-story tall areas of solar glass usually have behind this transparency a large two-story tall space in which the upper half is completely useless for human activity, even though it costs much money to enclose.

Past attempts to solve these problems have failed to meet simultaneously all of the following desirable conditions: thick insulation, light weight, tight coverage, easy movability, translucency, and useful yet economical architectural space. Also, without meeting those conditions, the concept of a house as a live-in solar collector is largely unworkable.

Accordingly, the principal object of the invention is to solve these problems presented by large areas of glass in a building, and especially by discomfort when the sun is shining and loss of heat energy when it is not.

A specific object of the invention is to provide a thermal barrier between a large window glass area and the inside of the building which meets all of the desirable conditions--thick insulation, light weight, tight coverage, easy movability, translucency, and efficient architecture.

Still another object of the invention is to provide such a thermal barrier which can be added to existing buildings.

Yet another object of the invention is to provide such a thermal barrier at a cost which is advantageous when savings in equipment, energy and usable space are taken into account.

SUMMARY OF THE INVENTION

The above and other objects of the invention are accomplished with a building having a large glass wall by providing, in accordance with the invention, a thermal barrier having a thermal-insulated horizontal stationary rail panel adjacent to the glass wall. A translucent thermal-insulated horizontal movable inner panel is positioned between the rail panel and the glass wall, and is movable from horizontal alignment with the rail panel to above the rail panel. A similar outer panel is positioned between the inner panel and the glass wall and is movable from horizontal alignment with the rail panel to below the rail panel. Panel mounting means supported from the building are adapted to movably support the inner and outer panels so that one may be moved above and the other below the rail panel to provide a translucent thermal barrier between the upper and lower portions of the glass wall and the inside of the building to supplement the thermal barrier provided by the rail panel.

A principal feature of the invention is the construction of the inner and outer panels. Each comprises light-transmitting walls separated by a translucent thermal insulation. Another feature of the panels is that each is made of several separate panel sections flexibly connected together. This construction avoids buckling problems due to heat expansion.

Another feature of the invention is the panel mounting means, which comprises a horizontal rotatable axle supported from the roof of the building. Chains connected to the tops of the inner and outer panels pass over sprocket wheels on the axle so that the inner and outer panels balance each other and less energy is needed to move them.

Still another feature of the invention is an automatic control system which is responsive to temperature sensors located between the glass wall and the movable panels and inside the building. These sensors automatically open and close the movable panels in order to avoid overheating of the building or loss of heat energy through the glass wall. This feature is enhanced by a third temperature sensor located on an outside north wall whose function is to close the movable panels when the outside temperature is above the inside temperature.

Yet another feature of the invention is a means of sealing around the outside and between the three panels to thermally isolate the area between the glass wall and the inner rail and outer panels when the inner and outer panels are fully closed.

An important advantage of this invention is that it automatically creates comfortable temperatures inside the building all year around.

Another advantage of the invention is that, when the inner and outer panels are fully closed, the thermal barrier provides substantial noise insulation so that noises generated outside of the building are much less audible indoors.

Still another advantage of the invention is that, with a manual override switch, the inner and outer panels can be closed to obtain visual privacy from outdoor observers and, at the same time, produce a feeling of intimacy and coziness in the rooms adjacent to the glass wall.

BRIEF DESCRIPTION OF THE DRAWINGS

These and other objects, features and advantages of the invention may be better understood by the following detailed description of the preferred embodiment of the invention taken in conjunction with the accompanying drawings in which:

FIG. 6 is a top detailed view taken along the lines 6—6 of FIG. 5 showing the panel motor drive connected to the axle, as well as an axle hanger containing a sprocket wheel from which hangs a chain that holds up the two movable panels.

FIG. 7 is a detailed view taken along the lines 7—7 of FIG. 5 showing the flexible connection between panel sections together with the channel guide means connected to the rail panel;

FIG. 8 is a detailed view taken along the lines 8—8 of FIG. 5 showing the solar sensor mounted in the solar sensor mounting box;

FIG. 9 is a detailed view taken along the lines 9—9 of FIG. 2B showing the channel guide means for the outer ends of the inner and outer panels, and the flexible vertical seals that press against the ends of the inner and outer panels when they are in closed position.

FIG. 10 is a front elevational view taken along the lines 10—10 of FIG. 8 showing how the solar sensor is mounted inside the solar sensor mounting box;

FIG. 11 is a detailed front elevational view taken along the lines 11—11 of FIG. 4 showing how the panel sections are constructed, supported and guided;

FIG. 12 is a detailed front elevational view taken along the lines 12—12 of FIG. 4 showing how the panel sections are hingeably connected together;

FIG. 13 is a detailed front elevational view taken along the lines 13—13 of FIG. 4 showing the channel guide means for the outer panel;

DETAILED DESCRIPTION

Figure 1:
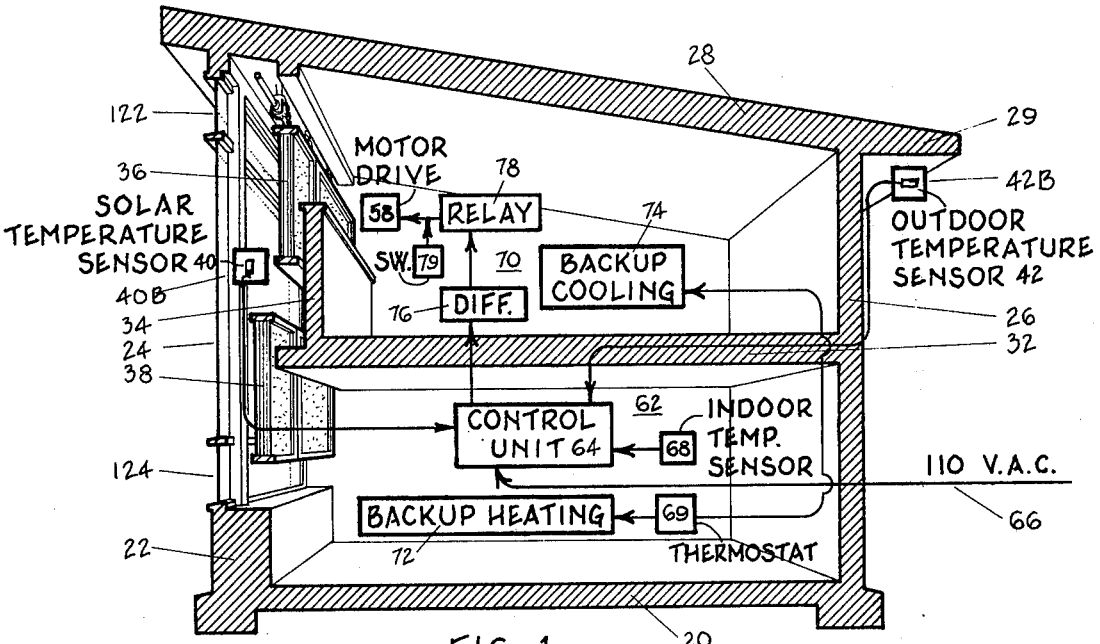
FIG. 1 is a diagrammatic cross-sectional view of a building having a two-story high glass wall with the movable inner and outer thermal-insulated panels shown in an intermediary position between being opened and closed, and including a schematic block diagram of the automatic control system for controlling the panel motor drive and heating and cooling units in response to the indoor temperature sensor, the solar sensor and, optionally, the outdoor temperature sensor.

Referring to FIG. 1 of the drawings, building 20 comprises front wall 22 with its glass wal 24 generally facing in a southerly direction, rear wall 26, roof 28, first floor 30, and second floor 32. Projecting vertically from the window wall end of second floor 32 is rail panel 34. Between the window wall 24 and rail panel 34 is inner panel 36 and outer panel 38. Mounted on a mullion of window wall 24 is solar sensor box 40. Mounted on the rear wall 26, beneath the roof eave 29, is outdoor temperature sensor box 42.

Figure 2A:
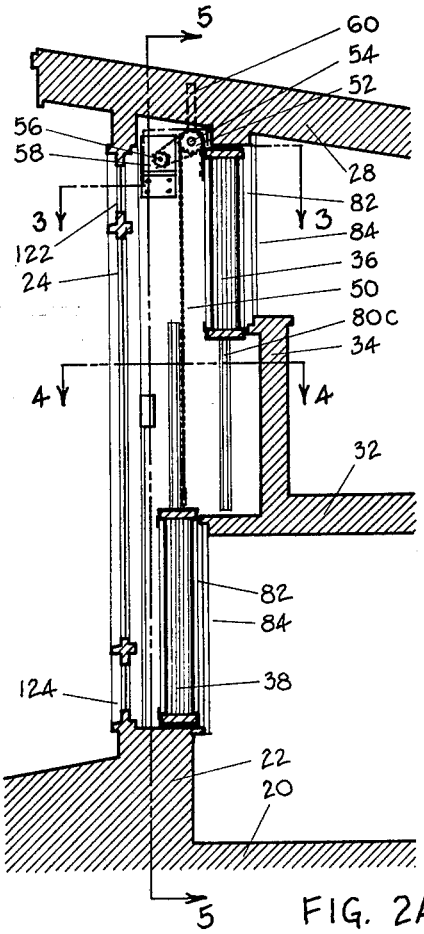
FIG. 2A is a view similar to FIG. 1 showing the inner and outer panels in closed position and thus providing a thermal, visual, and sound barrier between the glass wall and the inside of the building.
Figure 2B:
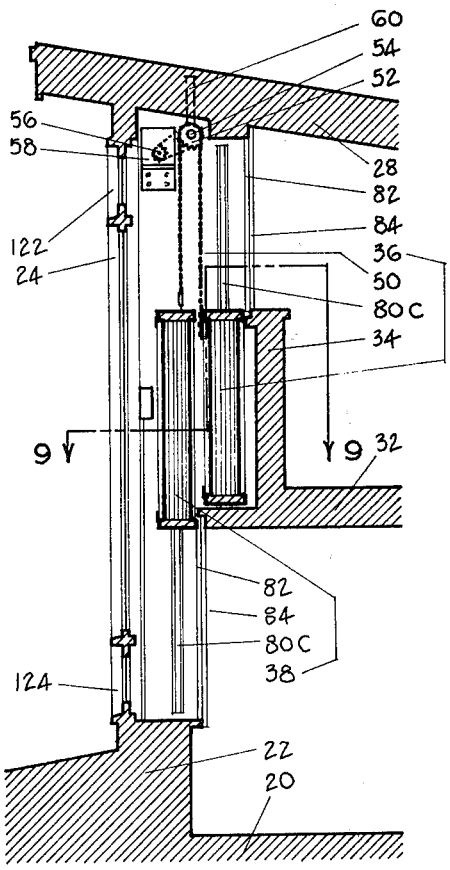
FIG. 2B is a view similar to FIG. 1 showing the inner and outer panels in open position and thus permitting solar heat to enter the building.

The inner panel 36 and the outer panel 38 are supported by chains 50 (see FIGS. 2A and 2B showing one of the chains 50) which pass over sprocket wheels 52 mounted on an axle 54. The axle 54 (also see FIG. 6) is rotatably driven via gear 56 of motor drive mechanism 58. The axle 54 is supported from roof 28 by hangers 60.

The motor drive mechanism 58 is basically a garage door motor drive system with associated slip clutches and gear controls. When the input terminals of motor drive mechanism 58 are momentarily shorted it rotates axle 54 until the inner panel 36 and outer panel 38 are moved either to a fully closed position (as shown in FIG. 2A) or to a fully open position (as shown in FIg. 2B). More particularly, if the panels 36 and 38 are fully open, then the operation of motor drive mechanism 58 will fully close them. Or, if panels 36 and 38 are already fully closed, momentary shorting of the input terminals of motor drive mechanism 58 will cause the panels to fully open.

The automatic control system 62 to open and close panels 36 and 38 is shown in block diagram in FIG. 1. Automatic control system 62 comprises control unit 64 whose inputs are the 110 volt AC line 66 to power the system, a solar sensor 40 (shown in FIG. 10 as located in solar sensor box 40B), an indoor temperature sensor 68, and an outdoor temperature sensor 42. The outputs of control unit 64 are the motor drive circuit 70, which comprises in series a differentiator 76, relay 78, and the motor drive mechanism 58. Differentiator 76 functions to differentiate any change in the voltage level output of control unit 64 in order to momentarily operate relay 78 which, in turn, momentarily shorts the input control terminals of the motor drive mechanism 58. Thus, with each change of output voltage level from control unit 64, the motor drive mechanism 58 is operated either to fully close or fully open panels 36 and 38. As will hereinafter be explained in greater detail, control unit 64 monitors the solar sensor 40, the indoor temperature sensor 68, and (optionally) an outdoor temperature sensor 42, to open or close panels 36 and 38 in order to prevent overheating of the indoor spaces when the sun is shinning in warm weather and loss of indoor heat when the sun is not shining in cold weather. Wall switch 79, which produces a momentary shorting contact, is connected directly to motor drive 58 and provides a manual override to open or close panels 36 and 38 manually for the purpose of privacy or reducing externally generated noise inside the building 20.

An accessory part of the automatic control system 62 is a thermostat control 69 with backup heating 72 and backup coolig 74. This serves to keep interior spaces comfortable during those brief times when intense outdoor cold makes indoor temperatures fall below the lower limit of comfort dialed on the thermostat 69, or when intense outdoor heat makes indoor temperatures rise above the upper limit of comfort dialed on the control unit 64.

Figure 3:
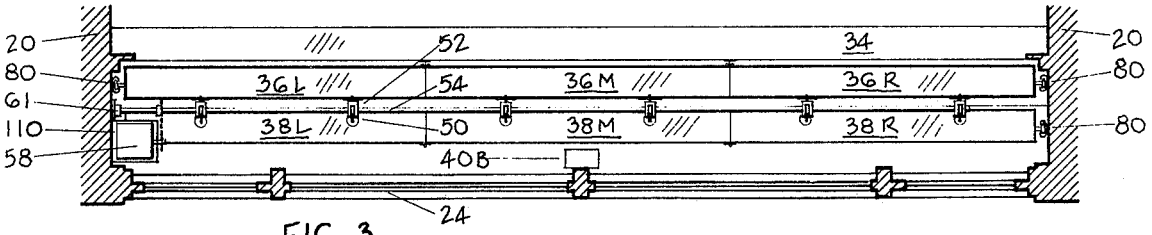
FIG. 3 is a top view along the lines 3—3 of FIG. 2A showing the panel motor driving the axle and thus the sprocket wheels which are chain-connected to the movable inner and outer panels.
Figure 4:
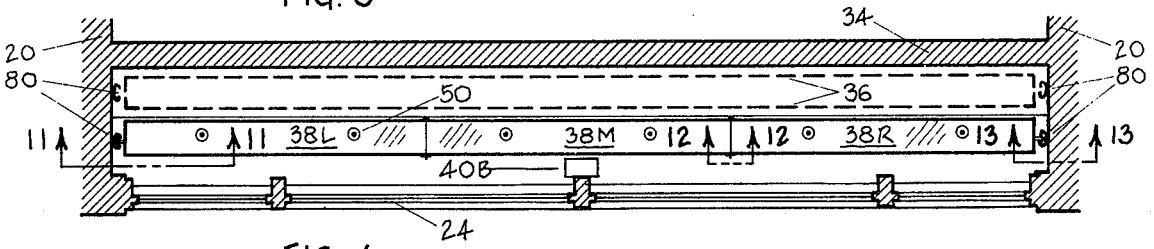
FIG. 4 is a top view along the lines 4—4 of FIG. 2A showing the relative positions of the inner, outer and rail panels with respect to the glass wall.
Figure 5:
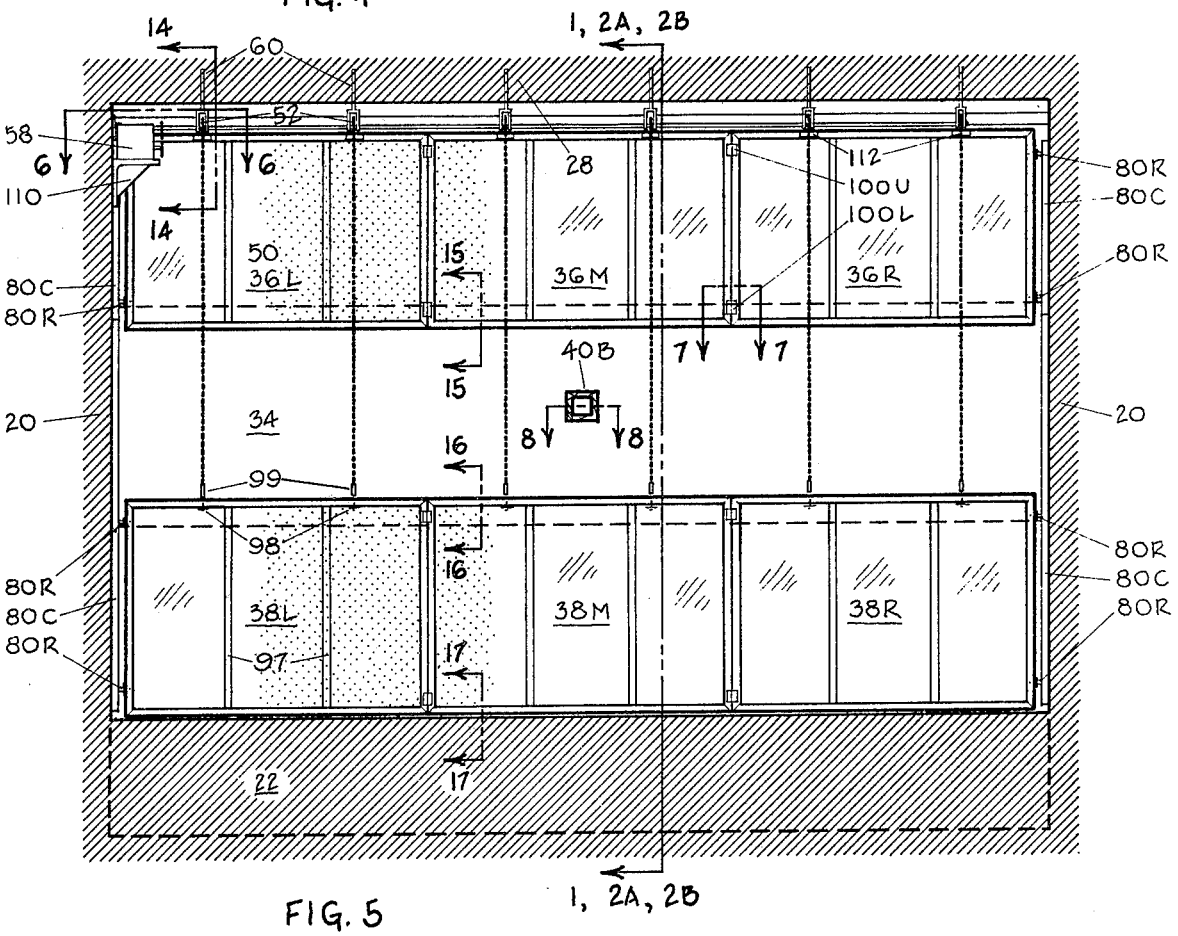
FIG. 5 is a front sectional view taken along the lines 5—5 of FIG. 2A showing the movable inner and outer panel as comprising three flexibly-connected panel sections, with the inner and outer panels in closed position.

The arrangement of the panels 36 and 38 and the panel mounting means is shown in detail in FIGS. 3–5. In FIG. 5 the inner panel 36 and outer panel 38 are shown in closed position with the rail panel 34 indicated by the horizontal dashed lines (since the FIG. 5 view is taken just inside glass wall 24). Inner panel 36 consists of three flexibly connected panel sections 36L, 36M, and 36R (from left to right). Similarly, outer panel 38 consists of three flexibly connected panel sections 38L, 38M, and 38R. Each of the panel sections is supported by a pair of chains 50, with the ends of each chain 50 connected to the top portion of each panel section. Each chain 50 passes over a sprocket wheel 52 on axle 54. Axle 54 is driven by motor drive mechanism 58. The vertical guide channel means 80 at eachend of panels 36 and 38 and fastened to side walls 20 keeps panels 36 and 38 in the proper vertical alignment.

The motor drive mechanism 58 is shown in greater detail in FIG. 6, together with part of one vertical guide channel means 80 and the insulating header 29 constructed above the inner panel 36. Motor drive mechanism 58 drives axle 54 via drive gear 56, drive chain 57, and axle drive gear 59. The axle 54 is supported by hangers 60 connected from the roof and by the axle and plate 61 located only at the axle end near the motor 58. The axle end plate 61 and each axle hanger 60 contain ball bearings that enable the axle to rotate smoothly.

FIG. 7 shows how two adjacent panel sections are flexibly connected, as well as the construction of each panel section. For example, panel section 36M (as well as all other panel sections) consists of two spaced translucent plastic panes 90 and 92 separated by layers of translucent plastic insulation 94 such as bubblepak. The outer edge of each pane 90 and 92 is mounted within a surrounding box frame 96 comprising wooden top and bottom frame members 96T and 96B and left and right frame members 96L and 96R. A pair of panel connecting members 98 (see FIGS. 5 and 11) connect each panel section to its associated pair of chains 50.

The panel sections such as panel sections 36L and 36M are flexibly connected by hinges 100 screwed into the associated left and right frame members 96L and 96R (FIG. 12), with a pair of hinges 100U on the outer sides of the upper portions of panel sections 36L and 36M and a corresponding pair of hinges 100L on the outer sides of the lower portions of panel sections 36L and 36M. Separating each pair of adjacent panel sections is a compressible rubber seal 102 (see FIGS. 7 and 12) running along the full length of the seam between each left and right frame member 96L and 96R (FIG. 12). The compressible rubber seal 102 allows for heat expansion of the panel sections, provides insulation, and prevents air from passing through the panel seams. Channel guide means 104 (FIG. 7) located on the inner side of each panel seam keep each of the panel sections in its proper vertical track. Each panel guide means 104 consists of a panel guide knob 104K, a groove 104G cut into the corners of panel frame members 96L and 96R, and two trim pieces 104T which hold each panel guide knob in place.

The construction of the solar sensor mounting box 40 for the solar sensor 40S is shown in FIGS. 8 and 10. The box 40, constructed from pine or similar softwood and screwed to mullion 110 of the glass wall 24, is designed to keep the solar sensor 40S out of the direct rays of the sun. The construction of outdoor temperature sensor box 42 (FIG. 1) and the mounting of its outdoor temperature sensor 42S inside (not shown) is substantially the same. However, whereas the solar sensor mounting box 40S is mounted with its back in a vertical plane, the outdoor temperature sensor box 42S is mounted against the underside of the north roof eave with its back in a horizontal plane and its open side facing downward.

FIG. 9 shows how the panels 36 and 38 are kept in alignment by the guide channel means 80 as the panels move up and down, and also shows the vertical sealing members 82 that function when the panels 36 and 38 are in closed position. Vertical guide channel means 80 consists of vertical channel 80C mounted against the inside face of the building's side walls 20, and channel guide roller 80R which fits into and slides up and down in channel track 80C and whose stem is connected to the outer edge faces of the panels 36 and 38. The channel guide roller 80R (which contains ball bearings that allow it to rotate easily) connects to the panel frame members 96R and 96L at each end via a metal bushing 80B (into which the stem of the guide roller 80R is inserted) that is mounted tightly in the end faces of the outer frame members 96R and 96L. There are eight guide rollers 80R and metal bushings 80B in all: four in the outer panel 38 (two at each end, with one near each top and one near each bottom) and four in the inner panel 36 (two at each end, with one near each top and one near each bottom).

The vertical sealing member 82 shown in FIG. 9 is made from soft flexible rubber material and extends vertically for the full height along the inside faces of both outer ends of panels 36 and 38 when said panels are in closed position. Each vertical seal 82 is fastened along its whole length to a piece of wood blocking 83 (nailed into the building's side walls 20) and presses against the inside face of each panel frame member 96R and 96L when panels are in closed position. To hide the unaesthetic vertical seal 82 from indoor view, a piece of wood molding 84 is fastened to the inside face of each wood blocking 83.

FIGS. 11–13 taken together comprise a front elevational view of the outer panel 38, which except for the connecting members 98 and turnbuckles 99 is the same as inner panel 36. FIG. 11 shows a front elevational view of the panel frames 96B, 96L, and 96T; the mottled surface of the outer translucent plastic pane 92; the lower front guide roller 80R as it fits into the vertical channel 80C mounted against the inside face of the building's side wall 20; and how each connecting member 98 is bolted to its associated top horizontal frame member 96T at about a quarter of the panel section length from each outer edge. Inner panel framing member 97 exists at approximate ⅓ points along the length of each panel section, and serves to strengthen the panel sections and allow the translucent insulation to be installed in easily obtainable widths of approximately 32 inches.

FIGS. 14–17 taken together show a cross-sectional view of the main physical components of the invention, with the inner panel 36 and outer panel 38 shown in their closed positions and in dotted outline in their open positions.

Figures 14, 15, 16, 17:
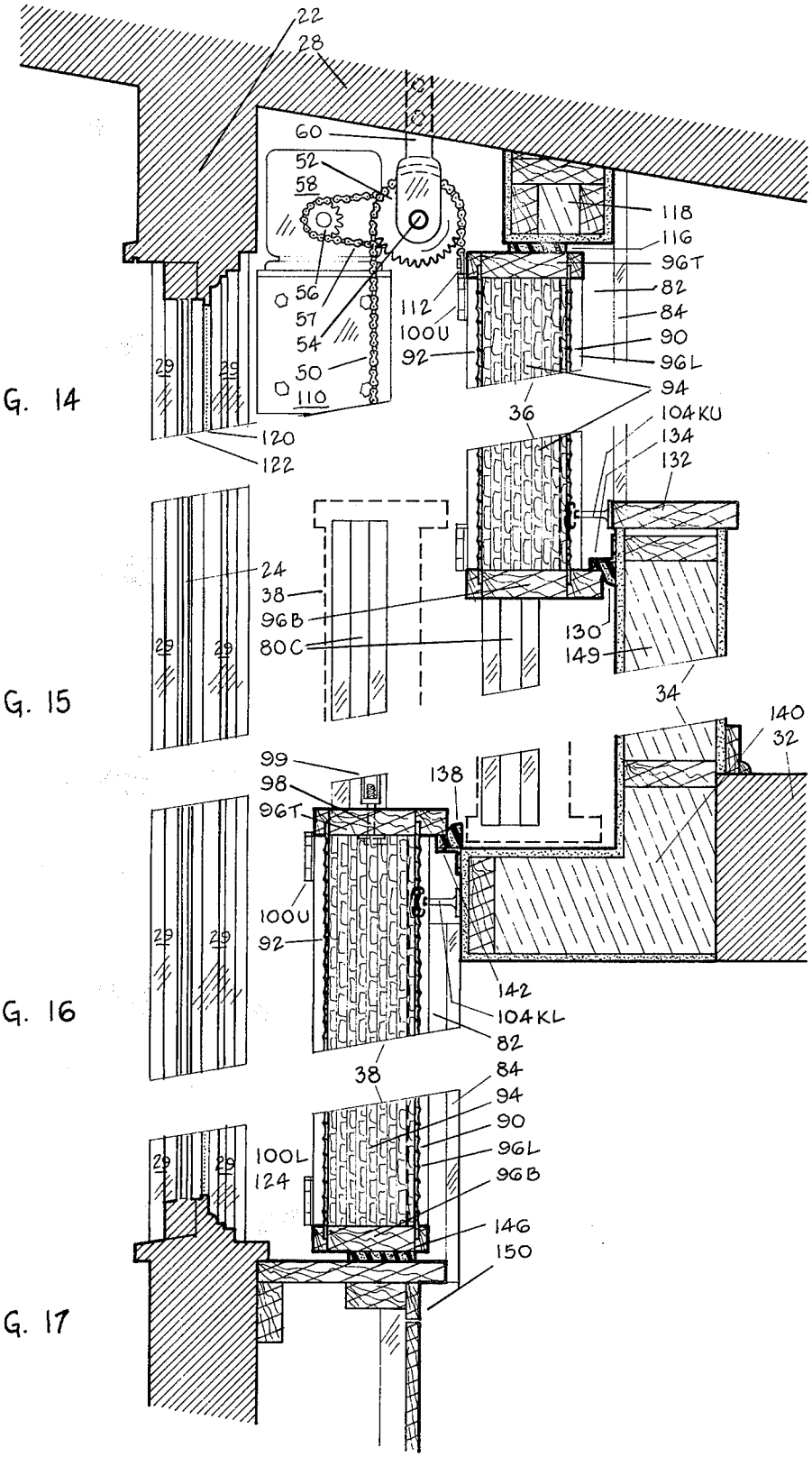
FIG. 14 is a detailed cross-sectional view taken along the lines 14—14 of FIG. 5 showing the panel motor driving the axle, the sprocket wheel with the chain connected to the inner panel, and how the top of the inner panel is sealed along the inner wall header when the panels are in closed position.
FIG. 15 is a detailed cross-sectional view taken along the lines 15—15 of FIG. 5 showing how the inner panel is sealed along the lower edge of the top horizontal railing of the rail panel when the panels are in closed position.
FIG. 16 is a detailed cross-sectional view taken along the lines 16—16 of FIG. 5 showing how the top of the outer panel is sealed against the lower rail panel extension when the panels are in closed position.
FIG. 17 is a detailed cross-sectional view taken along the lines 17—17 of FIG. 5 showing how the outer panel is sealed along the base wall when the panels are in closed position.

Referring particularly to FIG. 14, motor drive mechanism 58 is mounted on an L-shaped bracket 110 bolted to structural members behind the inside wall of building 20. Inner panel 36 is connected to chain 50 by panel connector 112 bolted to the top panel frame 96T of inner panel 36. Soft rubber seal 116 is adhered to header 118. As indicated above, the inner panel 36 (as well as the outer panel 38) is constructed in a wooden frame with translucent plastic panes 90 and 92 separated by a multi-layered insulation (preferably bubblepak 94). Bubblepak 94 is made from a clear plastic on which are flat bubbles of plastic about one inch in diameter and three-eighths inch thick. While the plastic is basically transparent, the net effect of the multilayers of bubblepak is that the insulation 94 is translucent. Thus, the combination of the translucent panes 90 and 92 and the bubblepak insulation 94 is to produce a panel which is translucent. Thus, the panels 36 and 38 are light-transmitting so that when they are closed ample light passes through them into the interior spaces of the building 20.

Also shown in FIG. 14 is screen 120 to screen a top openable window 122 (FIG. 1). A similar screen 123 (FIG. 17) screens a bottom window 124 (FIG. 1). The purpose of openable windows 122 and 124 is to provide ventilation, especially when the panels 36 and 38 are closed and the air between the glass wall and the thermal barrier formed by the panel is excessively hot. Around the glass are shown the side moldings 29.

When the panels 36 and 38 are closed, they combine with rail panel 36 to produce a thermal barrier. Soft rubber seal 130 (FIG. 15) is adhered along the total length of rail panel 34 just below its railing 132 and beneath L-angle 134. L-angle 134 holds seal 130 and is screwed into the framing of rail panel 34. Similarly, soft rubber seal 138 (FIG. 16) is adhered along the total length of rail panel extension 140 which extends from the structure of second floor 32. More particularly, seal 138 is adhered to L-angle 142 which is screwed into the framing of rail panel extension 140. Finally, a soft rubber seal 146 (FIG. 17) is adhered along the entire length of the underside of outer panel 38. Thus, when the panels 36 and 38 are fully closed, the horizontal seals 116, 130, 138, and 146 together with the end vertical seals 82 (FIG. 9), 87 (FIG. 9), and the seam vertical seals 102 located between the panel sections 38 (FIG. 7) produce a fully insulated thermal barrier between the glass wall 24 (FIG. 1) and the adjacent interior spaces of building 20.

FIGS. 14–17 also show elevational views of the vertical sealing members 82 that extend for the full height along the inside of both outer ends of panels 36 and 38 when said panels are in closed position. Also shown are the pieces of wood molding 84 that are fastened to the pieces of wood blocking 83 (see FIG. 9) located behind the seals 82.

FIGS. 15 and 16 also show a side view of the assembly of the panel guide knobs 104K which hold the seams of the flexible panel sections at the proper distance from the top and bottom of the rail panel 34. The upper guide knows 104KU are screwed into the outer edge of the rail panel railing 132; and the lower guide knobs 104KL are screwed into the framing inside the rail panel extension 104. All cavities between the framing members of rail panel 34 and rail panel extension 140 are filled with fiberglass batt insulation 149.

FIGS. 15 and 16 furthermore show an elevational view of the vertical channels 80C located at each end of the outer panel frame 38 and inner panel frame 36. Each pair of outer vertical channels 80C extends from the bottom of panel frame 96B of outer panel 38 when in closed position to the top of panel frame 96T of said panel when in open position; and each pair of inner vertical channels 80C extends from the bottom of panel frame 96B of inner panel 36 when in open position to the top of panel frame 96T of said panel when in closed position.

OPERATION

A thermal barrier in accordance with the invention can control the flow of huge amounts of British Thermal Units (BTUs) in and out of building 20 all year round, even when no one is in the building.

The thermostat 69 is of the type that has a temperature setting for establishing the lower limit (in degrees F. or C.) of the desired comfort zone; while the control unit 64 has a temperature setting for establishing the upper limit of the desired comfort zone. For example, say the occupants of the building 20 want the temperature of its interior spaces always to remain between 67 and 77 degrees F. In this case, the occupant would dial the thermostat 69 dial to 67 degrees (the lower limit of the comfort zone) and the control unit 64 dial to 77 degrees (the upper limit of the comfort zone).

For a typical winter day, the automatic control system operates as follows. At sunrise, it is cold outside, sunrays are weak, and the panels 36 and 38 are closed. Assume that the indoor temperature sensor 68 senses 67 degrees or above and the temperature in the enclosed space between the closed panels 36 and 38 and the southerly glass 24 is well below 67 degrees. As the morning sun becomes stronger, it raises the temperature of this enclosed space. When this temperature reaches eight degrees F. warmer then the temperature sensed by indoor temperature sensor 68 (which would be 75 degrees if the indoor temperature is 67 degreees), control unit 64 responds by opening the panels 36 and 38; and solar energy begins flowing indoors. All day long room temperatures steadily rise. Any thermal reservoirs inside absorb excess heat for replenishing at night. If and when the indoor temperature rises above the upper limit of 77 degrees, control unit 64 responds by closing panels 36 and 38.

If, when the panels 36 and 38 are open, the sky should become cloudy and solar temperature sensor 40 senses a temperature less than 3 degrees above the sensed indoor temperature, then control unit 64 responds by closing panels 36 and 38. And if the clouds go away, the moment the solar temperature sensor 40 senses a temperature of eight degrees above the indoor temperature, control unit 64 again opens panels 36 and 38.

Late in the afternoon, as the sun weakens, the sensed solar temperature falls. The moment solar temperature sensor 40 senses a temperature less than three degrees above the sensed indoor temperature, control unit 64 closes the panels 36 and 38 to keep in the collected heat.

In the evening, while outdoor temperatures are low, heat passes very slowly through the thickly insulated envelope of building 20. As it does, heat from any thermal reservoirs trickles back into the interior spaces. Whenever the temperature sensed by thermostat 69 falls below 67 degrees, thermostat 69 turns on backup heating 72 to raise the temperature in the indoor space to 67 degrees. In the summer, thermostat 69 is set to turn on the backup cooling at 77 degrees.

Outdoor temperature sensor 42 may optionally be used to enhance the function of the automatic control system 62. In this event, when the outdoor temperature sensor 42 senses that the outdoor temperature is eight degrees warmer than the indoor temperature sensed by indoor temperature sensor 68, control unit 64 responds by closing the panels 36 and 38 if they are open. The purpose is to prevent outdoor heat from flowing through the glass wall 24 during warm weather due to the panels being open.

The automatic control system 62 operates in a similar fashion in the summer time.

If the panels 36 and 38 get out of synchronism with control unit 64, say the panels are open when they should be closed, then manual switch 79 may be momentarily operated to return the panels 36 and 38 to the correct position.

The motor drive mechanism may be an electric garage door opener of the type supplied by Sears, Roebuck and Co. (example: Order No. 64H6638), in which the panels 36 and 38 may be operated by radio control.

The thermostat 69 may be a Honeywell micro-electronic Chromotherm Model T8200A with a sub-base model Q6000A1005.

Control Unit 64 may be a C-120 differential temperature control and performance monitoring unit supplied by Independent Energy Inc. of East Greenwich, R.I. The C-120 would be programmed in accordance with the instructions provided in the *C1 00/C1 20 Programming Installation, and Application Manual* published by Independent Energy Inc., No. 100141 Rev. C.

What is claimed is:

1. In a building having at least two floors and a two-story high glass wall generally facing in a southerly direction, a thermal barrier comprising:

(A) a thermal-insulated stationary rail panel mounted behind said glass wall and in a position intermediate between the top and bottom of said glass wall;

(B) a translucent thermal-insulated vertically movable inner panel positionable between the vertical plane of said rail panel and said glass wall and adapted to be moved into a position in horizontal alignment with said rail panel;

(C) a translucent thermal-insulated vertically movable outer panel positionable between the vertical plane of said inner panel and said glass wall and adapted to be moved into a position in horizontal alignment with said rail panel and spaced a predetermined distance from said glass wall to form an air space between said outer panel and said glass wall; and (D) panel mounting means connected to said building and adapted to movably support said inner panel and said outer panel so that one of said panels may be move from adjacent said ral panel to above said ral panel to provide a translucent thermal barrier between the upper portion of said glass wall and the inside of said building, and the other of said panels may be moved from adjacent said rail panel to below said rail panel to provide a translucent thermal barrier between the lower portion of said glass wall and the inside of said building; and (E) whereby when said inner and outer panels are in horizontal alignment with said rail panel, heated air in said air space rises via convection and passes over said horizontally aligned panels into the interior of said building and is replaced by cooler interior air entering from below said horizontally aligned panels.

2. A thermal barrier according to claim 1 wherein said panel mounting means connected to said building comprises:

(E) a horizontal rotatable axle supported from the roof of said building;

(F) a plurality of sprocket wheels mounted on said rotatable axle; and (G) a plurality of chains, with each of said chains connected at one end to said inner panel and at the other end to said outer panel and passing over and being driven by one of said sprocket wheels.

3. A thermal barrier according to claim 2 wherein each of said inner and outer panels is of substantially the same weight so that said inner and outer panels balance each other.

4. A thermal barrier according to claim 1 wherein each of said inner and outer panels comprises light-transmitting walls separated by a translucent thermal insulation.

5. A thermal barrier according to claim 3 wherein each of said inner and outer panels comprises light-transmitting walls separated by a translucent thermal insulation.

6. A thermal barrier according to claim 4 wherein each of said inner and outer panels comprises a plurality of panel sections flexibly connected together.

7. A thermal barrier according to claim 6 wherein each of said inner and outer panels comprises three panel sections connected together by hinges.

8. A thermal barrier according to claim 5 wherein each of said inner and outer panels comprises three panel sections connected together by hinge means.

9. A thermal barrier according to claim 6 further comprising channel guide means coupling each of said inner and outer panels to said rail panel.

10. A thermal barrier according to claim 8 wherein each of said panel sections is coupled to said rail panel by channel guide means.

11. A thermal barrier according to claim 10 wherein said hinge means comprises an upper hinge connecting the upper portions of adjacent panel sections together and a lower hinge connecting the lower portions of adjacent panel sections together.

12. A thermal barrier according to claim 11 wherein said channel guide means for adjacent panel sections comprises a left trim piece mounted along the right vertical edge of a panel section and a right trim piece mounted along the left vertical edge of the adjacent panel section, and a guide knob projecting from the rail panel and slidably movable within said left and right trim pieces.

13. A thermal barrier according to claim 9 further comprising second channel guide means coupling the outside edge of each of said inner and outer panels to said building.

14. A thermal barrier according to claim 12 further comprising second channel guide means coupling the outer edge of each of said inner and outer panels to said building.

15. A thermal barrier according to claim 14 wherein said second channel guide means comprises a channel guide roller projecting from each of the outer edges of said inner and outer panels into an associated vertical channel mounted on said building.

16. A thermal barrier according to claim 4 wherein said rail panel has a lower rail panel extension projecting toward said glass wall.

17. A thermal barrier according to claim 16 wherein said inner panel abuts said rail panel extension when said inner panel is positioned in horizontal alignment with said rail panel.

18. A thermal barrier according to claim 16 wherein said rail panel has a top horizontal railing with an adjacent extension partially extending from said rail panel toward said glass wall, said inner panel has a horizontal extension extending from its lower edge toward said rail panel, and sealing means mounted along the lower edge of said adjacent extension adapted to be pressed between said inner panel horizontal extension and said adjacent extension beneath said top horizontal railing when said inner panel is in its maximum upper position adjacent said glass wall.

19. A thermal barrier according to claim 16 wherein said outer panel has a horizontal extension extending from its upper edge toward said rail panel, and sealing means mounted along the upper outer edge of said lower rail panel extension and adapted to be pressed between said outer panel horizontal extension and said lower rail panel extension when said outer panel is in its maximum lower position adjacent said glass wall.

20. A thermal barrier according to claim 18 wherein said outer panel has a horizontal extension extending from its upper edge toward said rail panel, and second sealing means mounted along the upper outer edge of said lower rail panel extension and adapted to be pressed between said outer panel horizontal extension and said lower rail panel extension when said outer panel is in its maximum lower position adjacent said glass wall, whereby said inner and outer panels and said rail panel are adapted to provide a complete thermal barrier between the inside of said building and said glass wall when said inner and outer panels are moved to their maximum positions away from said rail panel.

21. A thermal barrier according to claim 2 further comprising:

(H) motor drive means coupled to said horizontal rotatable axle for rotating said axle to move said inner and outer panels from adjacent said rail panel to above and below said rail panel;

(I) control means coupled to said motor drive means for controlling said motor-drive means;

(J) an indoor sensor connected to said contol means; and (K) a solar sensor mounted between said inner and outer panels and said glass wall and connected to said control means;

(L) said control means being responsive to predetermined conditions of said indoor sensor and said solar sensor for operating said motor drive means to move said inner and outer panels from adjacent said rail panel to above and below said rail panel to provide a translucent thermal barrier between said glass wall and the inside of said building.

22. A thermal barrier according to claim 21 further comprising a thermostat, and backup heating means responsive to said thermostat for heating the building in accordance with a predetermined temperature condition sensed by said thermostat.

23. A thermal barrier according to claim 22 further comprising cooling means responsive to said thermostat for cooling the building in accordance with a predetermined condition sensed by said thermostat.

24. A thermal barrier according to claim 1 wherein each of said translucent inner and outer panels comprises two translucent panels separated by a multi-layered light-transmitting insulation.

25. A thermal barrier according to claim 24 wherein said multi-layered light-transmitting insulation comprises a plurality of clear plastic sheets on which are flat bubbles of plastic.

26. A thermal barrier according to claim 25 wherein said flat bubbles are about three-eighths inch thick.

27. A thermal barrier according to claim 26 wherein said multi-layered light-transmitting insulation comprises about eight layers.

28. A thermal barrier according to claim 27 wherein said multi-layered light-transmitting insulation is about three inches thick.

29. A thermal barrier according to claim 24 wherein each of said translucent inner and outer panels is at least three inches thick.

30. A thermal barrier according to claim 27 wherein said multi-layered light-transmitting insulation is about three inches thick.

31. A thermal barrier according to claim 13 further comprising a vertical sealing member parallelling said second channel guide means along the outside edge of each of said inner and outer panels and adapted to provide a thermal seal between said inner and outer panels and said building when said inner and outer panels are positioned above and below said rail panel.

32. A thermal barrier according to claim 21 wherein said control means is responsive to a temperature sensed by said solar sensor which is higher than a temperature sensed by said indoor sensor to align said inner and outer panels with said rail panel.

33. A thermal barrier according to claim 21 further comprising an outdoor sensor, said control means being responsive to a difference between the temperatures sensed by said outdoor sensor and said indoor sensor to move said inner and outer panels to above and below said rail panel.

34. In a building having a glass wall, a thermal barrier comprising:

(A) a thermal-insulated stationary rail panel supported behind said glass wall and in a position intermediate between the top and bottom of said glass wall;

(B) a light-transmitting thermal-insulated vertically movable first panel adapted to be moved into a position in horizontal alignment with said rail panel;

(C) a light-transmitting thermal-insulated vertically movable second panel adapted to be moved into a position in horizontal alignment with said rail panel and spaced a predetermined distance from said glass wall to form an air space between said second panel and said glass wall;

(D) panel mounting means connected to said building and adapted to movably support said first panel and said second panel so that one of said panels may be moved from horizontal alignment with said rail panel to above said rail panel to provide a light-transmitting thermal barrier between the upper portion of said glass wall and the inside of said building, and the other of said panels may be moved from horizontal alignment with said rail panel to below said rail panel to provide a light-transmitting thermal barrier between the lower portion of said glass wall and the inside of said building; and (E) whereby when said first and second panels are in horizontal alignment with said rail panel, heated air in said air space rises via convection and passes over said horizontally aligned panels into the interior of said building and is replaced by cooler interior air entering from below said horizontally aligned panels.

35. A thermal barrier according to claim 34 wherein each of said light-transmitting first and second panels comprises two light-transmitting panels separated by a multi-layered light-transmitting insulation.

36. A thermal barrier according to claim 35 wherein said multi-layered light-transmitting insulation comprises a plurality of clear plastic sheets on which are flat bubbles of plastic.

37. A thermal barrier according to claim 36 wherein said flat bubbles are about three-eighths inch thick.

38. A thermal barrier according to claim 37 wherein said multi-layered light-transmitting insulation comprises about eight layers.

39. A thermal barrier according to claim 35 wherein each of said light-transmitting first and second panels is at least three inches thick.

40. A thermal barrier according to claim 34 wherein said panel mounting means connected to said building comprises:

(E) a plurality of support members; and (F) a plurality of flexible connecting members, with each of said flexible connecting member connected between said first and second panels via one of said support members.

41. A thermal barrier according to claim 40 wherein each of said first and second panels is of substantially the same weight so that said first and second panels balance each other.

42. A thermal barrier according to claim 34 wherein each of said first and second panels comprises light-transmitting walls separated by light-transmitting thermal insulation.

43. A thermal barrier according to claim 41 wherein each of said first and second panels comprises light-transmitting walls separated by translucent thermal insulation.

44. A thermal barrier according to claim 34 wherein each of said first and second panels comprises a plurality of panel sections flexibly connected together.

45. A thermal barrier according to claim 44 further comprising channel guide means coupling each of said first and second panels to said rail panel.

46. A thermal barrier according to claim 34 furher comprising channel guide means coupling the outer edge of each of said first and second panels to said building.

47. A thermal barrier according to claim 34 wherein said panel mounting means comprises:

(E) a horizontal rotatable axle supported from the roof of said building;

(F) a plurality of sprocket wheels mounted on said rotatable axle; and (G) a plurality of chains, with each of said chains connected at one end to said first panel and at the other end to said second panel and passing over one of said sprocket wheels.

48. A thermal barrier according to claim 47 further comprising:

(H) motor drive means coupled to said horizontal rotatable axle for rotating said axle to move said first and second panels from adjacent said rail panel to above and below said rail panel;

(I) control means coupled to said motor drive means for controlling said motor drive means;

(J) an indoor sensor connected to said control means; and (K) a solar sensor connected to said control means;

(L) said control means being responsive to predetermined conditions sensed by said indoor sensor and said solar sensor for operating said motor drive means to move said first and second panels from adjacent said rail panel to above and below said rail panel to provide a translucent thermal barrier between said glass wall and the inside of said building.

49. A thermal barrier according to claim 48 further comprising:

(M) an outdoor temperature sensor connected to the outside of said building and coupled to said control means;

(N) said control means also being responsive to a predetermined condition sensed by said outdoor temperature sensor for operating said motor drive means to provide or remove the translucent thermal barrier from between said glass wall and the inside of said building.

50. A thermal barrier according to claim 46 further comprising a vertical sealing member parallelling said channel guide means along the outside edge of each of said first and second panels and adapted to provide a thermal seal between said first and second panels and said building when said first and second panels are positioned above and below said rail panel.

51. A thermal barrier according to claim 48 wherein said control means is responsive to a temperature sensed by said solar sensor which is higher than a temperature sensed by said indoor sensor to align said first and second panels with said rail panel.

52. A thermal barrier according to claim 51 further comprising an outdoor sensor, said control means being responsive to a difference between the temperature sensed by said outdoor sensor and said indoor sensor to move said first and second panels to above and below said rail panel.

* * * * *